United States Patent [19]

Hollingsworth et al.

[11] Patent Number: 4,861,503

[45] Date of Patent: Aug. 29, 1989

[54] ZERO-PHOSPHOROUS DETERGENT POWDERS CONTAINING ALUMINOSILICATE, SUCCINATE AND POLYCARBOXYLATE POLYMER

[75] Inventors: Michael W. Hollingsworth, Bebington; Peter J. Russell, Eastham, both of England

[73] Assignee: Lever Brothers Company, New York, N.Y.

[21] Appl. No.: 198,680

[22] Filed: May 24, 1988

Related U.S. Application Data

[63] Continuation of Ser. No. 921,664, Oct. 21, 1986, abandoned.

[30] Foreign Application Priority Data

Nov. 1, 1985 [GB] United Kingdom ..... 8526999

[51] Int. Cl.[4] ..... C11D 3/08; C11D 3/12; C11D 11/02

[52] U.S. Cl. ..... 252/135; 252/174.19; 252/174.24; 252/174.25; 252/558; 252/559

[58] Field of Search ..... 252/135, 174.25, 174.19, 252/174.24, 559, 539, 540

[56] References Cited

U.S. PATENT DOCUMENTS

| | | | |
|---|---|---|---|
| 3,998,762 | 12/1976 | Murata et al. | 252/551 |
| 4,303,556 | 12/1981 | Llendado | 252/527 |
| 4,645,616 | 2/1987 | Niven et al. | 252/135 |

FOREIGN PATENT DOCUMENTS

| | | |
|---|---|---|
| 139523 | of 0000 | European Pat. Off. . |
| 0001310 | 4/1979 | European Pat. Off. . |
| 0001853 | 5/1979 | European Pat. Off. . |
| 63399 | 10/1982 | European Pat. Off. . |
| 130640 | 1/1985 | European Pat. Off. . |
| 58-204098 | 11/1983 | Japan . |
| 2097419 | 11/1982 | United Kingdom . |

*Primary Examiner*—Prince E. Willis
*Attorney, Agent, or Firm*—Milton L. Honig

[57] ABSTRACT

Low or zero-phosphate spray-dried detergent powders containing less than 10% sodium silicate are structured with a combination of a succinic acid salt and a film-forming polymeric polycarboxylate. The preferred detergency builder is alkali metal aluminosilicate.

9 Claims, No Drawings

ZERO-PHOSPHOROUS DETERGENT POWDERS CONTAINING ALUMINOSILICATE, SUCCINATE AND POLYCARBOXYLATE POLYMER

This is a continuation application of Ser. No. 921,664, filed on Oct. 21, 1986 now abandoned.

TECHNICAL FIELD OF INVENTION

The present invention relates to detergent powders containing relatively low levels of sodium silicate, or none at all, and to a process for preparing them. The present invention is of especial applicability to detergent powders which also contain reduced levels of phosphate builders, or none at all, and particularly to detergent powders built with alkali metal aluminosilicate.

BACKGROUND AND PRIOR ART

Alkali metal aluminosilicates, both crystalline (zeolites) and amorphous, are effective detergency builders which can be used to replace sodium tripolyphosphate (STP) in detergent powders, but they do not possess an ability comparable to that of STP to contribute to the structure of a spray-dried powder. Alkali metal silicates are frequently included in detergent powders as structurants providing a robust surface to the spray-dried particle, to reduce washing machine corrosion and to increase alkalinity. It is well known, however, that if aluminosilicate and silicate are together in a detergent slurry they can interact unfavourably: agglomeration of the aluminosilicate occurs to give powders containing large particles which are slow to disperse in the wash liquor, giving reduced washing performance.

For this reason attempts have been made to reduce the level of sodium silicate included in spray-dried powders built with aluminosilicates, but this tends to cause deterioration of the flow properties (dynamic flow rate, compressibility) of the powders. Alternative structurants are therefore needed to compensate for the reduced silicate level.

EP 61 295B (Unilever) describes and claims a spray-drying process for the preparation of crisp, free-flowing detergent powders containing less than 6% by weight of phosphate (calculated as phosphorus) and less than 4% by weight of sodium silicate. According to that process, the slurry which is spray-dried to form a powder includes a water-soluble salt of succinic acid, preferably sodium succinate. The succinic acid salt may be wholly or partially neutralised.

We have now found that even better powder properties may be achieved using succinic acid salts incorporated at levels of 0.5 to 2.5% by weight as structurants, if there is also included in the slurry a film-forming polymeric polycarboxylate, in an amount of from 0.5 to 10% by weight based on the final powder.

Ep 1310A (Procter & Gamble) discloses spray-dried zero-phosphate or low-phosphate detergent powders built with zeolite and containing materials such as sodium citrate as supplmentary builders or pH regulators. The Examples contain sodium citrate levels ranging from 6 to 20% by weight, and also contain varying amounts of methyl vinyl ether/maleic anhydride copolymerrs (Gantrez (Trade Mark) AN 119 and AN 136 ex GAF); it is stated that the sodium citrate may be replaced by sodium succinate. EP 1853B (Procter & Gamble) contains a similar disclosure, with Examples containing 4 to 15% by weight of sodium citrate and 0.8 to 2% by weight of Gantrez polymer. In those Examples the sodium citrate, or the sodium succinate which may replace it, is functioning as a detergency builder or pH regulator.

Our discovery, on the other hand, is concerned with the structurant properties of succinates, at levels too low for building efficacy, when combined with polymers. Citrates do not have these properties.

DEFINITION OF THE INVENTION

The present invention provides a granular spray-dried detergent composition containing less than 6% by weight (calculated as phosphorus) of phosphate builders and comprising (a) one or more anionic and/or nonionic detergent-active compounds,.

(b) one or more non-phosphate detergency builders, (c) optionally from 0 to 10% by weight of sodium silicate, (d) from 0.5 to 2.5% by weight of a wholly or partially neutralised water-soluble salt of succinic acid, (e) from 0.5 to 10% by weight of a film-forming polymeric polycarboxylate.

The present invention further provides a process for the preparation of a granular spray-dried detergent composition containing less than 6% by weight (calculated as phosphorus) of phosphate builders, which comprises the steps of (i) forming an aqueous crutcher slurry comprising one or more anionic and/or nonionic detergent-active compounds, one or more non-phosphate detergency builders, optionally from 0 to 10% by weight of sodium silicate, from 0.5 to 2.5% by weight of a wholly or partially neutralised water-soluble salt of succinic acid, and from 0.5 to 10% by weight of a polymeric polycarboxylate; and (ii) spray-drying the slurry to form a powder.

All the percentages quoted above are based on the final composition, including any ingredients that may be postdosed to the spray-dried powder.

DESCRIPTION OF THE INVENTION

The invention is concerned with crisp, free-flowing spray-dried detergent powders containing less than 6% by weight (calculated as phosphorus), and preferably less than 2.5% by weight, of phosphate builders. Structuring, and hence good powder properties, are achieved by inclusion in the slurry of a succinic acid salt and a polymeric polycarboxylate. The powders may contain up to 10% by weight, preferably from 2 to 6% by weight, of sodium silicate, but if desired sodium silicate may be omitted altogether.

The succinic acid salt is preferably wholly or partially neutralised sodium succinate. It is present at the relatively low level of from 0.5 to 2.5% by weight, 1.0 to 2.0% by weight being preferred.

The polymeric polycarboxylate is used in an amount of from 0.5 to 10% by weight, preferably from 1.0 to 5.0% by weight.

The molecular weight of the film-forming polymeric polycarboxylate is preferably from 10 000 to 100 000, more preferably from 20 000 to 70 000. All molecular weights quoted herein are those provided by the polymer manufacturers.

Preferred polymeric polycarboxylates are homopolymers of acrylic acid or methacrylic acid, and copolymers of acrylic or methacrylic acid with maleic acid. Of especial interest are polyacrylates, acrylic acid/maleic acid copolymers, and acrylic phosphinates.

Suitbale polymeric polycarboxylates which may be used alone or in combination, include the following:

salts polyacrylic acid, for example Versicol (Trade Mark) E7 ex Allied Colloids, average molecular weight 27 000; Narlex (Trade Mark) LD 34 ex National Adhesives and Resins Ltd, average molecular weight 25 000; and Sokalan (Trade Mark) PA 50 ex BASF, average molecular weight 30 000;

acrylic acid/maleic acid copolymers, for example, Sokalan (Trade Mark) CP5 and CP7 ex BASF, average molecular weights 70 000 and 50 000; and acrylic phosphinates, for example, the DKW range ex National Adhesives and Resins Ltd or the Belsperse (Trade Mark) range ex Ciba-Geigy AG, as disclosed in EP 182 411A (Unilever).

Mixtures of any two or more film-forming polymers may if desired be used in the compositions of the invention.

If desired, the structurant system of the present invention may be combined with the use of the novel structurants—crystal-growth-modified sodium carbonate monohydrate and/or crystal-growth-modified Burkeite—described and claimed in our copending application of even date claiming the priority of British patent application Nos. 85 26996 and 86 12459 filed on Nov. 1, and May 22, 1986 respectively.

According to a preferred embodiment of the invention, the sole or principal non-phosphate detergency builder is a crystalline or amorphous alkali metal aluminosilicate, which may suitably be present in an amount of from 10 to 60% by weight, based on the final powder. The alkali metal (preferably sodium) aluminosilicates used in the compositions of the invention may be either crystalline or amorphous or mixtures thereof, and they have the general formula $$0.18\text{–}1.5Na_2O.Al_2O_3.0.8\text{–}6\ SiO_2.$$

These materials contain some bound water and are required to have a calcium ion exchange capacity of at least about 50 mg CaO/g. The preferred sodium aluminosilicates contain 1.5–3.5 $SiO_2$ units (in the formula above) and have a particle size of not more than about 100 μm, preferably not more than about 20 μm. Both the amorphous and crystalline sodium aluminosilicates can be made readily by reaction between sodium silicate and sodium aluminate, as amply described in the literature.

Suitable crystalline sodium aluminosilicate ion-exchange detergency builders are described, for example, in GB 1 473 201 (Henkel) and GB 1 429 143 (Procter & Gamble). The preferred sodium aluminosilicates of this type are the well-known commercially available zeolites A and X, and mixtures thereof.

The invention is especially useful for compositions containing relative high levels of aluminosilicate, for example, from 25 to 40% by weight.

Other builders may also be included in the compositions of the invention if necessary or desired: suitable organic or inorganic water-soluble or water-insoluble builders will readily suggest themselves to one skilled in the art, and include alkali metal carbonates, citrates and nitrilotriacetates. Low levels of phosphate builders, for example, sodium orthophosphate, pyrophosphate or tripolyphosphate, may be present provided that the 6% upper limit for phosphorus content is not exceeded. Preferred compositions of the invention, however, are substantially free of phosphate builders.

Otherinorganic salts without a detergency building function, for example, sodium sulphate, may also be included in the compositions of the invention.

Sodium silicate, as previously indicated, may be present in an amount of up to 10% by weight, preferably from 2 to 6% by weight. The sodium silicate used may be of any normal type: the sodium oxide to silica mole ratio (R) is preferably from 1:1.5 to 1:3.3, more preferably from 1:1.8 to 1:2.5.

The compositions of the invention also contain anionic and/or nonionic detergent-active compounds (surfactants).

Anionic surfactants are well-known to those skilled in the detergents art. Examples includes alkylbenzene sulphonates, particularly sodium alkylbenzene sulphonates having an average chain length of $C_{12}$; primary and secondary alcohol sulphates, particularly sodium $C_{12}$–$C_{15}$ primary alcohol sulphates; olefin sulphonates; alkane sulphonates; and fatty acid ester sulphonates.

Nonionic surfactants that may be used in the compositions of the invention include the primary and secondary alcohol ethoxylates, especially the $C_{12}$–$C_{15}$ primary and secondary alcohols ethoxylated with an average of from 3 to 20 moles of ethylene oxide per mole of alcohol.

It may also be desirable to include one or more soaps of fatty acids. The soaps which can be used are preferably sodium soaps derived from naturally occurring fatty acids, for example the fatty acids from coconut oil, beef tallow, or sunflower oil.

Anionic surfactants, both soap and non-soap, will generally be incorporated via the slurry, while nonionic surfactants may either be incorporated in the slurry or postdosed.

The total amount of detergent-active material (surfactant), excluding soap, in the detergent powders of the invention is preferably within the range of from 5 to 40% by weight. This may suitably be constituted by from 5 to 35% by weight of anionic surfactant, and optionally up to 5% by weight of nonionic surfactant. In compositions containing 30% by weight or more aluminosilicate builder, the anionic surfactant level is preferably less than 25% by weight.

Detergent compositions in accordance with the present invention may also contain any other of the ingredients conventionally present, notably antiredeposition agents; antiincrustation agents; fluorescers; enzymes; bleaches, bleach precursors and bleach stabilisers; perfumes, including deoperfumes; and dyes. These may be added to the aqueous slurry or post-dosed into the spray-dried powder according to their known suitability for undergoing spray-drying processes.

Detergent powders of the invention built with zeolite (crystalline sodium aluminosilicate) may typically contain the following amounts of the principal ingredients:

| | Weight % |
|---|---|
| Surfactant (nonionic and/or anionic) | 5–40 |
| Variable Zeolite | 10–60 |
| Sodium silicate | 0–10 |
| Polymeric polycarboxylate | 0.5–10 |
| Sodium succinate | 0.5–2.5 |

The invention will now be illustrated by the following non-limiting Examples.

EXAMPLES

Example 1

Four powders containing zeolite as the principal builder and including various particle structurant systems were prepared by slurry-making and spray-drying.

For additional structuring, each of these powders also contained crystal-growth-modified Burkeite, as described and claimed in our copending application of even date claiming the priority of British patent application Nos. 85 26996 and 86 12459 filed on Nov. 1, 1985 and May 22, 1986 respectively.

For each powder a slurry was prepared, at about 48% moisture content at about 80° C. Crystal-growth-modified Burkeite was produced as the first component in the slurry by reaction of sodium sulphate and sodium carbonate in the presence of an aqueous solution of the polyacrylate crystal growth modifier. The remaining ingredients were then added, the film-forming polymer being incorporated towards the end of the slurry-making process. Heat-sensitive minor ingredients (enzyme, perfume) were postdosed to the spray-dried powder.

Powder 1 in accordance with the invention contained 1.5% by weight of film-forming polymer and 1.5% by weight of sodium succinate; powder A (comparative) contained sodium succinate but no polymer; powder B (comparative) contained polymer but no sodium succinate; and powder C (comparative) contained polymer together with sodium citrate.

The ingredients were as shown in Table 1, percentages being based on the final powder.

TABLE 1

| | 1 | A | B | C |
|---|---|---|---|---|
| Linear alkylbenzene sulphonate (1) | 21.0 | 21.0 | 21.0 | 21.0 |
| Nonionic surfactant (2) | 2.0 | 2.0 | 2.0 | 2.0 |
| Hardened tallow soap | 1.0 | 1.0 | 1.0 | 1.0 |
| Zeolite (as 100% active ingredient | 35.0 | 35.0 | 35.0 | 35.0 |
| Sodium silicate (2.OR) | 4.0 | 4.0 | 4.0 | 4.0 |
| Sodium succinate | 1.5 | 1.5 | NIL | NIL |
| Sodium citrate | NIL | NIL | NIL | 2.0 |
| Film-forming polymer (3) | 1.5 | NIL | 1.5 | 1.5 |
| Sodium carbonate | 10.0 | 10.0 | 10.0 | 10.0 |
| Sodium sulphate | 12.2 | 13.7 | 13.7 | 11.7 |
| Crystal growth modifier (4) | 0.2 | 0.2 | 0.2 | 0.2 |
| Minor ingredients (fluorescer, antiredeposition agent, deoperfume, enzyme etc) | 3.2 | 3.2 | 3.2 | 3.2 |
| Moisture | 8.4 | 8.4 | 8.4 | 8.4 |
| | 100.0 | 100.0 | 100.0 | 100.0 |

(1) Petrelab (Trade Mark) 550 ex Petresa
(2) Synperonic (Trade Mark) A7 ex ICI ($C_{12}$–$C_{15}$ primary alcohol, 7 EO)
(3) Sokalan (Trade Mark) CP5 ex BASF
(4) Narlex (Trade Mark) LD 34 ex National Adhesives and Resins Ltd.

The physical properties of the powders are shown in Table 2. The "flow figure" D-C, the difference between the numerical values of the dynamic flow rate and the compressibility, is based on the empirical observation that powders having a value of less than 50 are not suitable for handling on a production scale.

TABLE 2

| Powder Properties | 1 | A | B | C |
|---|---|---|---|---|
| Bulk density, g/liter | 355 | 361 | 400 | 360 |
| Dynamic flow rate D, ml/sec | 109 | 89 | 85 | 60 |
| Compressibility C, % v/v | 30 | 40 | 39 | 30 |
| "Flow figure" D–C | 79 | 49 | 46 | 30 |
| Storage for 6 weeks at | | | | |

TABLE 2-continued

| Powder Properties | 1 | A | B | C |
|---|---|---|---|---|
| 28° C./70% RH: | | | | |
| powder caking, % | nil | 15 | 10 | — |
| powder insolubles in 20° C. water, % | 8 | 23 | 10 | — |
| "Flow figure" D–C | 65 | 41 | 39 | — |

The superiority of the powder of the invention over all three controls will be noted. The control powder C containing sodium citrate rather than sodium succinate, in accordance with the prior art, showed especially poor flow properties, although time did not allow its behaviour after 6 weeks' storage to be determined.

Examples 2 & 3

Two further powders in accordance with the invention were prepared, by a combination of spray-drying and postdosing. The ingredients were as shown in Table 3.

TABLE 3

| | 2 | 3 |
|---|---|---|
| (a) Via slurry | | |
| Linear alkylbenzene sulphonate | 20.0 | 18.0 |
| Nonionic surfactant | 1.0 | — |
| Hardened tallow soap | 1.0 | — |
| Zeolite | 35.0 | 32.0 |
| Sodium silicate | 5.0 | 5.0 |
| Sodium succinate | 2.0 | 1.0 |
| Film-forming polymer | 1.5 | 1.5 |
| Sodium carbonate | 5.0 | 10.0 |
| Sodium sulphate | 11.2 | 20.3 |
| Crystal growth modifier | 0.1 | 0.15 |
| Minor ingredients (fluorescer, antiredeposition agent etc) | 1.0 | 0.95 |
| Moisture | 9.0 | 9.0 |
| (b) Postdosed | | |
| Nonionic surfactant, sprayed on | 1.0 | — |
| Sodium carbonate (as granular soda ash) | 5.0 | — |
| Minor ingredients (enzyme, perfume etc) | 2.2 | 2.1 |

The surfactants and polymers were as used in Example 1, and the slurries were prepared in the same way.

The final powders had the following flow properties after 6 weeks' storage at 28° C./70% RH:

| | 2 | 3 |
|---|---|---|
| Dynamic flow rate D, ml/s | 88 | 89 |
| Compressibility C, % v/v | 29 | 29 |
| Flow figure D–C | 59 | 60 |

We claim:

1. A granular spray-dried detergent composition substantially free of phosphate builders and comprising:
(a) one or more detergent-active compounds selected from the group consisting of anionic, nonionic and detergent-active mixtures thereof,
(b) one or more non-phosphate detergency builders, comprising from 25 to 60% by weight of crystalline or amorphous sodium aluminosilicate,
(c) from 0 to 10% by weight of sodium silicate,
(d) from 0.5 to 2.5% by weight of a compound selected from the group consisting of succinic acid, water-soluble salts of succinic acid, and mixtures thereof, (e) from 0.5 to 5% by weight of a film-forming polymeric polycarboxylate selected from the group consisting of polyacrylate, arcylic acid/maleic acid copolymer and acrylic phosphinate.

2. A composition as claimed in claim 1, which comprises from 2 to 6% by weight of sodium silicate (c).

3. A composition as claimed in claim 1, which comprises from 25 to 40% by weight of a crystalline or amorphous alkali metal aluminosilicate.

4. A composition as claimed in claim 1, which comprises from 1.0 to 5.0% by weight of the polymeric polycarboxylate (e).

5. A composition as claimed in claim 1, wherein the polymeric polycarboxylate has a weight average molecular weight of from 10,000 to 100,000.

6. A composition as claimed in claim 1, wherein the succinic acid salt (d) is sodium succinate.

7. A composition as claimed in claim 1, which comprises from 5 to 35% by weight of one or more anionic detergent-active compounds and from 0 to 5% by weight of one or more nonionic detergent-active compounds.

8. A composition according to claim 7 wherein said anionic detergent-active compound is a linear alkylbenzene sulfonate and said nonionic detergent-active compound is a $C_{12}$–$C_{15}$ alcohol ethoxylated with an average of from 3 to 20 moles ethylene oxide per mole of alcohol.

9. A process for the preparation of a granular spray-dried detergent composition substantially free of phosphate builders, which comprises the steps of:

(i) forming an aqueous crutcher slurry comprising one or more anionic and/or nonionic detergent-active compounds, one or more non-phosphate detergency builders, said builders comprising from 25 to 60% by weight of crystalline or amorphous sodium aluminosilicate, from 0 to 10% by weight of sodium silicate, from 0.5 to 2.5% by weight of a compound selected from the group consisting of succinic acid, water-soluble salts of succinic acid, and mixtures thereof, and from 0.5 to 5.0% by weight of a film-forming polymeric polycarboxylate; and (ii) spray-drying the slurry to form a powder, all percentages being based on the final powder.

* * * * *